United States Patent [19]

Weatherly et al.

[11] 4,095,003

[45] June 13, 1978

[54] DUPLEX COATING FOR THERMAL AND CORROSION PROTECTION

[75] Inventors: Merle Howard Weatherly, Indianapolis; Robert Clark Tucker, Jr., Brownsburg, both of Ind.

[73] Assignee: Union Carbide Corporation, New York, N.Y.

[21] Appl. No.: 721,863

[22] Filed: Sep. 9, 1976

[51] Int. Cl.[2] ..... C23C 7/00; C23D 5/00

[52] U.S. Cl. ..... 427/34; 148/31.5; 427/419 R; 428/632; 428/633; 428/939

[58] Field of Search ..... 148/31.5; 427/34, 419 R; 29/195 A, 195 M; 428/632, 633, 687, 939

[56] References Cited

U.S. PATENT DOCUMENTS

| | | | |
|---|---|---|---|
| 3,197,291 | 7/1965 | Michael | 29/195 M |
| 3,837,894 | 9/1974 | Tucker | 148/31.5 X |

*Primary Examiner*—Michael R. Lusignan

*Attorney, Agent, or Firm*—Dominic J. Terminello

[57] ABSTRACT

A duplex coating and method for making same wherein a primary layer of metals or metal alloys is deposited on a superalloy substrate to seal the substrate against oxidation. A second layer of low density oxide is deposited on the surface of the primary layer. The primary layer has a rough surface so as to provide an adherent surface for the oxide layer.

6 Claims, No Drawings

DUPLEX COATING FOR THERMAL AND CORROSION PROTECTION

This invention relates to an article and method for coating such article with a duplex coating having thermal and corrosion resistance. More particularly the invention relates to a coating for providing thermal and corrosion resistance to a superalloy substrate employed in a hot corrosive environment.

Coatings have been developed to protect superalloy substrates from oxidation, sulfidation and other forms of corrosive attack. Coatings have also been developed to provide thermal insulation. Further, coatings have been developed to provide both thermal insulation and to a limited extent corrosion resistance. A typical prior art coating of this type is a plasma deposited or thermal spray duplex coating wherein the first or primary layer is a nickel-chromium, nickel-aluminum, CoCrAlY, NiCrAlY or a similar alloy material over which is applied a zirconia outer layer. These coatings do not provide adequate corrosion protection because neither layer is effectively sealed, that is they have interconnected porosity extending throughout the coating. They are therefore permeable to air and other corrosive material and the substrate as well as the primary layer is rapidly attached at high temperature. This attack not only degrades the substrate but causes a spalling of the oxide layer. Thus both thermal protection and corrosion protection is lost.

The problem of permeability was overcome with the discovery of metallurgically sealed undercoats as described in U.S. Pat. No. 3,837,894 issued Sept. 24, 1974 to Robert C. Tucker Jr. Coatings of this type, being effectively sealed, do not suffer from excessive oxidation of either the coating or the substrate. In some cases effective sealing can also be achieved by heat treating plasma deposited coatings of alloyed powders at very high temperatures if the coatings are sufficiently dense and not significantly oxidized in the as-deposited state. However, one drawback of the later technique is that not all substrates can be heat treated without degrading the properties of the substrate as a result of the high temperature exposure.

It was found, however, that even though any significant amount of oxidation of primary coating or substrate was eliminated, a second conventional oxide layer deposited on the first or primary metallic layer would still spall when the coating system was exposed to high temperature service. Thus it was obvious that a duplex coating had to be developed which not only was impermeable to corrosive media but did not have the problem of the oxide layer spalling from the primary or first layer.

In the course of development work it was observed that spallation usually occurred as a result of cracking near the interface between the oxide layer and the first layer, predominantly within the oxide, even though no microcracks were evident in the system before service. A stronger oxide layer might therefore seem to be a potential solution to the problem based on crack initiation theory even though the mechanism of failure was not completely understood. Experimentation showed, however, that lower density, and therefore presumably weaker oxide layers performed better. Thermal shock resistance, although improved, was nontheless inadequate.

Since spallation still occurred predominantly at the interface, the effect of the topology of the interface was explored. Crack initiation often occurs at points of stress concentration such as the peaks and valleys of a rough surface or interface, thus it might be assumed that a smooth interface between the oxide layer and the first layer would be advantageous. Moreover, a smooth interface would present less surface area susceptible to oxidation. It was found, however, that a rougher, not smoother, interface resulted in better oxide adherence.

Accordingly it is an object of this invention to provide a coating for a superalloy substrate which prevents oxidation of the substrate while providing thermal insulation.

Another object is to provide an article and method for producing such article which has thermal and corrosion resistance.

The present invention resides in depositing a primary layer on a substrate such as nickel, cobalt or iron base superalloys by the plasma processes. The primary layer consists of a metal or metal alloy selected from the class consisting of nickel alloys, cobalt alloys, iron alloys and mixtures thereof with additions of at least one metal selected from the group consisting of 10–50 wt.% chromium, 5–25% aluminum, 0.5 to 10 wt.% of another metal selected from the class consisting of yttrium, rare earth metals, hafnium, tantalum, tungsten, zirconium, platinum, rhodium, paladium and silicon. The primary layer has a surface roughness of greater than $250 \times 10^{-6}$ inch arithmetic average (AA). A second layer is deposited on the rough surface of said primary layer and consists of an oxide taken from the class consisting of zirconia, stabilized zirconia, magnesium zirconate, and alumina. The second layer has a density of less than 88%.

In the practice of the invention a superalloy substrate is coated by plasma depositing a layer of prealloyed powder of the desired composition. The powder size and operating parameters are selected to provide a surface roughness of greater than $250 \times 10^{-6}$ inches AA. Normally the powder size must have a significant fraction greater than 44 microns. Unfortunately it is difficult to seal coatings made from coarse powder by heat treatment at temperatures that are not detrimental to the properties of the substrate. Preferably the primary layer is therefore deposited as two separate and distinct sublayers, the first sublayer is produced from powders being almost all less than 44 microns while the second sublayer has significant fraction greater than 44 microns. Coatings made with such fine powder as are used in the first sublayer more readily seal during heat treatment. Thus, after heat treatment, a coating layer is provided which is both effectively sealed with an impermeable first sublayer which prevents attack of the substrate and a second sublayer which is rough enough to provide an adherent surface for the oxide layer. Although the first sublayer will inherently have a relatively smooth surface, bonding between the first and second sublayer will be metallurgically sound as a result of metal to metal sintering during a subsequent heat treatment. This type of bonding cannot be relied upon between the second sublayer and the oxide layer, however. On the rough surface of the second sublayer is plasma deposited an oxide layer of zirconia, stabilized zirconia, magnesium zirconate, or alumina. Stabilized zirconia is zirconia to which has been added CaO, $Y_2O_3$, MgO, or other oxides in an amount to prevent transformation of zirconia from one crystalline phase to another. A typical yttria stabilized zirconia used in the example hereinafter contains 12 wt.% yttria. Magnesium zirconate has a composition of 24.65 weight percent MgO with the balance $ZrO_2$ and is a multiphase oxide designated hereinafter as $MgO.ZrO_2$. The oxide layer has a density of less than 88%. This density is achieved by adjusting the gas flow, gas composition, amperage voltage, torch to work distance etc. The specific parameters will vary with the design of the plasma torch utilized for deposition. In the preferred mode of operation the coated substrate is heat treated in a vacuum, hydrogen, or inert gas atmosphere at a time and temperature sufficient to cause sintering. The particular time and temperature will depend on the composition of the primary layer. Alternatively the heat treatment can be performed after the primary layer is deposited and before the oxide layer is deposited on the primary layer.

Having described the invention in general terms, reference will now be made to specific examples and data illustrating the principle of the invention and teaching those skilled in the art how to practice the invention.

Most of the experimental demonstrations of the concepts of this invention were accomplished by oxidation testing of duplex coated 1 × 2 inch panels of a superalloy of several thicknesses coated over an area of 1 × 1¾ inch on one side. The superalloys were either Hastelloy X, a tradename of Cabot Corp. for a material which is nominally 1.5 cobalt; 22 chromium, 9 molybdenum, 6 tungsten, 18.5 iron, 0.10 C. and balance nickel, (all percentages are weight percent), with a thickness of 0.125 or 0.250 inches or Haynes 188, a tradename of Cabot Corp. for a material which is nominally 22 nickel, 22 chromium, 14.5 tungsten, 0.35 silicon, 0.09 lanthanum, 0.1 carbon and balance cobalt with a thickness of 0.040 or 0.125 inches. The cyclic oxidation consisted of rapidly inserting the coated panels into a furnace preheated to 1000° or 1100° C, holding for 20 to 24 hours in a low velocity flow of air in the furnace, then rapidly cooling the panels to ambient temperature by either allowing them to cool in air or quenching in water. It was found that the most severe of these tests was air cooling from the 1100° C furnace temperature. All of the tests cited here were performed in this manner. Tests performed 1000° C or when using a water quench resulted in the same relative ranking of materials, but took longer to complete.

The following example and data illustrate the significance of an effectively sealed primary layer. "Effectively sealed" shall mean that the interconnected porosity in the primary layer is substantially eliminated, but in any case does not extend to the substrate being coated. In this example substrate panels of Haynes 188 0.040 inches thick were coated with a primary layer consisting of two sublayers, the first sublayer was composed of a prealloyed powder of a particle size less 44 microns with a composition of 23 Cr, 13 Al, 0.65 Y, balance Co. The second sublayer was comprised of a prealloyed powder of a particle size with a significant fraction greater than 44 microns with a composition identical to the first sublayer. The surface roughness of the second sublayer was 320 × $10^{-6}$ inches AA. An oxide layer was deposited over the second sublayer and consisted of $MgO.ZrO_2$. The density of the oxide layer was 92%. All layers were deposited by the plasma deposition process.

One coated panel was heat treated at 1080° C for 4 hours in a vacuum. Another identical panel was not heat treated. These panels were subjected to the cyclic oxidation test described above. The panel that was not heat treated exhibited severe spallation after 48 hours total exposure. The primary layer was laced with internal oxides. On the other hand the heat treated panel while showing some spallation after 72 hours showed no significant oxidation of the primary layer or the substrate.

The following data illustrates the significance of the density of the oxide coating. In one set of experiments panels of Haynes 188 0.040 inches thick were coated with primary layers of a variety of compositions followed by an oxide layer of $MgO.ZrO_2$. The oxide layer had a density of either 92% or 87%. Oxide thicknesses of 0.004 and 0.012 inches were compared. The data is summarized in the following Table I.

TABLE I

| OXIDE | | PRIMARY COATING | | | TEST | |
|---|---|---|---|---|---|---|
| Density*** | Thickness, inches | Composition | Type | Roughness $10^{-6}$in.AA | Hrs.at Temp. | Results |
| 92 | .004 | Co-23Cr-13Al-65Y | MS* | 290 | 100 | Edges Spalled |
| 87 | | | | | 100 | N.D. |
| 92 | .012 | " | MS* | 290 | 100 | Edges Spalled |
| 87 | | | | | 100 | N.D. |
| 92 | .004 | Ni-17Cr-15Al | MS* | 320 | 24 | Edges Spalled |
| 87 | | | | | 100 | N.D. |
| 92 | .012 | " | MS* | 320 | 24 | Edges Spalled |
| 87 | | | | | 100 | N.D. |
| 92 | .012 | Co-23Cr-13Al-65Y | PA** | 320 | 100 | Edges Spalled |
| 87 | | | | | 100 | N.D. |
| 92 | .004 | " | PA** | 240 | 100 | Severe Edges Sp. |
| 87 | | | | | 100 | Similar Edges Sp. |
| 92 | .012 | " | PA[1] | 320 | 100 | Edge Spalling |
| 87 | | | | | 100 | N.D. |

[1]Two sublayers of prealloyed
*MS-metallurgically sealed single primary layer
**PA-prealloyed single primary layer
***Density in percent of measured powder density of 4.99 g/cc with the 92% coating having a measured density of 4.57 g/cc and the 87% a measured density of 4.35 g/cc.

From the foregoing table it will be observed that at a density of 87 no damage (N.D.) (that is no spallation) to the coating system occurred when the primary surface was 290 × $10^{-6}$ in. AA or greater. While at 92% density the coating system did spall. It also will be noticed that when the surface roughness of the primary layer dropped to 240 × $10^{-6}$ AA even at 87% density some edge spalling occurred. Similar results were obtained with a Hastelloy X substrate 0.250 inches thick using a prealloyed Co-23Cr-13Al-.65Y primary coating. The effectiveness of the use of two sublayers in the primary layer as previously described were evident in examining the microstructure of the above examples. All but one pair of these had a single primary layer which after testing showed some internal oxidation of the primary layer and a minor amount of oxidation of the substrate. Although at this point in the life of the coating this oxidation had not resulted in any spallation of the low density oxide layers it was evident that eventually such oxidation would prematurely terminate their utility. On the other hand the pair with the primary coating composed of two sublayers showed no internal oxidation of the first sublayer, no oxidation of the substrate and only a minor amount of oxidation of the second sublayer. It was obvious that the life of this coating would be very much longer than its counterpart with a single primary coating layer.

Another set of experiments used an yttria stabilized zirconia oxide layer over a primary layer of two sublayers of Ni-23Co-17Cr-12.5Al-.3Y, the first sublayer being prealloyed powder and the second sublayer being metallurgically sealed with a surface roughness of $340 \times 10^{-6}$ AA. The substrates were 0.125 inches thick Haynes 188 panels. When the oxide layer had a density of 89% (5.40 g/cc), spallation of the coating began after only 21 hours at temperature. When the oxide density was 86% (5.23 g/cc) the first signs of spallation initiation did not appear until after 87 hours at temperature.

The next set of data illustrates the importance of surface roughness at the interface between the primary layer and the oxide layer in the coating. All of the data was generated using Hastelloy X panels 0.040 inches thick with a primary layer of Co-23Cr-13Al-1.2Y and an oxide layer of $MgO.ZrO_2$ 0.012 inches thick with a density of 87% (4.35 g/cc). When the primary layer was made from a prealloyed powder and had a surface roughness of $240 \times 10^{-6}$ AA the oxide completely spalled after 92 hours of testing while a panel with a primary layer having a surface roughness of $320 \times 10^{-6}$ AA showed no spalling damage after 100 hours of testing. When the primary layer was metallurgically sealed and had a surface roughness of $240 \times 10^{-6}$ AA approximately one third of the oxide spalled in 100 hours while a similar primary layer with a surface roughness of $290 \times 10^{-6}$ AA showed no damage at 100 hours. Similar results were obtained when the substrate was Hastelloy X 0.125 inches thick. Also similar results were obtained when the oxide layer thickness was 0.004 inches and the substrate was Hastelloy X 0.125 inches thick.

Throughout the above description when reference is made to density it is expressed as a percentage of the measured original powder density. In all of the above examples the primary layers tested were 0.005 or 0.0075 inches thick and the oxide layers 0.004 or 0.012 inches thick. This should not be construed in any way as a limitation on the invention, however, and both thinner and thicker primary or oxide layer thicknesses may be used.

Having described the invention in terms of preferred embodiments for illustrative purposes it should be noted that minor modifications can be made to the method of deposition, sequence of step taken and to the compositions without departing from the spirit and scope of the invention.

What is claimed is:

1. Method for producing a duplex coating on a substrate to impart thermal and corrosion resistance thereto comprising:

a. plasma depositing on said substrate as a primary layer a first sublayer wherein the particle size of the powder is less than 44 microns and then depositing a second sublayer on said first sublayer wherein the particle size of the powder has a significant fraction greater than 44 microns using powder consisting of a metal alloy selected from the class consisting of nickel alloys, cobalt alloys, iron alloys and mixtures thereof with additions of at least one metal selected from the group consisting of 10 to 50 wt.% chromium, 5 to 25% aluminum, 0.5 to 10wt.% of another metal selected from the class consisting of yttrium, rare earth metals, hafnium, tantalum, tungsten, zirconium, platinum, rhodium, paladium, and silicon, and said layer having a surface roughness of at least $250 \times 10^{-6}$ inches AA;

b. plasma depositing an oxide layer on said rough primary layer surface such oxide layer consisting of an oxide taken from the class consisting of zirconia, stabilized zirconia, magnesium zirconate and alumina and having a density of less than 88%;

c. and heat treating said duplex coating in a non-oxidizing atmosphere at a time and temperature to permit sintering of the components of the primary layer to cause effective sealing of the primary layer.

2. Method according to claim 1 wherein the heat treatment step is performed on the primary layer before the oxide layer is deposited.

3. Method according to claim 1 where in the heat treatment step is performed in a vacuum.

4. Method according to claim 1 wherein the heat treatment step is performed in an inert atmosphere.

5. Method according to claim 1 wherein the heat treatment step is performed in a hydrogen atmosphere.

6. Method according to claim 1 wherein the particle size of the powder comprising the primary layer has significant fraction greater than 44 microns.

* * * * *